United States Patent [19]

Newman

[11] Patent Number: 4,925,414

[45] Date of Patent: May 15, 1990

[54] MARINE PROPULSION SYSTEM

[75] Inventor: Neil A. Newman, Omro, Wis.

[73] Assignee: Brunswick Corporation, Skokie, Ill.

[21] Appl. No.: 241,615

[22] Filed: Sep. 8, 1988

[51] Int. Cl.[5] ..... B63H 23/02

[52] U.S. Cl. ..... 440/83; 440/111

[58] Field of Search ..... 440/53, 57, 75, 76, 440/83, 111, 112, 113

[56] References Cited

U.S. PATENT DOCUMENTS

| | | | |
|---|---|---|---|
| 1,745,235 | 1/1930 | Svendsen et al. | 440/75 |
| 3,051,119 | 8/1962 | Hamlyn | 440/53 |
| 3,396,692 | 8/1968 | Bergstedt | 440/112 |
| 3,583,357 | 6/1971 | Shimanckas | 440/111 |
| 4,003,330 | 1/1977 | Compton | 440/111 |
| 4,293,304 | 10/1981 | Sandstrom et al. | 440/83 |
| 4,382,797 | 5/1983 | Blanchard | 440/53 |
| 4,534,737 | 8/1985 | Henderson | 440/53 |
| 4,559,018 | 12/1985 | Nakahama et al. | 440/53 |
| 4,565,532 | 1/1986 | Connor | 440/57 |

*Primary Examiner*—Joseph F. Peters, Jr.
*Assistant Examiner*—Edwin L. Swinehart
*Attorney, Agent, or Firm*—Andrus, Sceales, Starke & Sawall

[57] ABSTRACT

A marine propulsion system for isolating engine sound and vibration from the boat interior includes an engine mounted in the aft portion of the boat by resilient mounts. The engine is enclosed within a closed compartment for isolating engine sound, with one wall of the compartment defined by the boat transom. The resilient engine mounts isolate the boat from the effects of engine vibration. A drive unit is rigidly mounted to the exterior of the boat transom. A drive mechanism is provided for transferring power from the engine crankshaft to the drive unit, and includes an apparatus for accommodating engine movements and isolating the drive unit from the effect of such movements.

8 Claims, 1 Drawing Sheet

MARINE PROPULSION SYSTEM

BACKGROUND AND SUMMARY

This invention relates to a marine propulsion system, and more particularly to an inboard-outboard type marine propulsion system.

The invention is designed to reduce or eliminate noise and vibration from an inboard mounted engine. The invention further provides an outboard mounted gearcase and drive unit, and a system for transferring power from the inboard mounted engine to the outboard mounted drive unit. The drive unit is mounted so as to be pivotable about a horizontal tilt axis, and steerable about a vertical steering axis.

In accordance with the invention, a marine propulsion system for use in a boat includes an engine adapted for mounting in the aft portion of the boat adjacent the transom. The engine is oriented so that its axis is substantially transverse to the axis of the boat. With this orientation, the engine crankshaft extends substantially parallel to the boat transom. A drive unit is mounted to the exterior of the transom, and includes a propeller interconnected with power transfer means for driving the propeller in response to rotation of the engine crankshaft. Drive means is provided for drivingly interconnecting the engine crankshaft with the power transfer means. In one embodiment, the engine is mounted in a chamber at the aft end of the boat for isolating the engine from the interior of the boat. One wall of the chamber is defined by the transom. The engine is mounted in the chamber by resilient mounting means for isolating the boat from engine vibrations. The drive unit is rigidly mounted to the exterior of the boat transom, and the power transfer means includes means for accommodating movement of the engine crankshaft resulting from engine vibration. The power transfer means includes a rotatable shaft disposed in the upper end of the drive unit defining a tilt axis about which the drive unit is pivotable. The engine crankshaft is interconnected with a rotatable output means, such as a sprocket, and the rotatable shaft in the upper end of the lower unit is provided with rotatable input means, such as a sprocket. A chain is provided about the output and input sprockets for transferring power therebetween. The means for accommodating movement of the engine crankshaft is preferrably associated with the output sprocket interconnected with the engine crankshaft. In one embodiment, the means for accommodating movement of the engine crankshaft includes a drive shaft interconnected with the engine crankshaft through a first flexible joint, such as a universal joint. The drive shaft is connected at its other end to the rotatable output sprocket through a second flexible joint, such as a universal joint. With the provision of universal joints at both ends of the drive shaft, engine vibration is isolated from the sprocket and thereby has little or no effect on the operation of the drive unit. In one embodiment, the sprocket is an axially extending hollow member, and the drive shaft extends substantially coaxially in the interior of the sprocket. The drive shaft is connected to an end of the passage in the hollow sprocket, and the teeth of the sprocket are located about the outer periphery of the sprocket at its other end.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
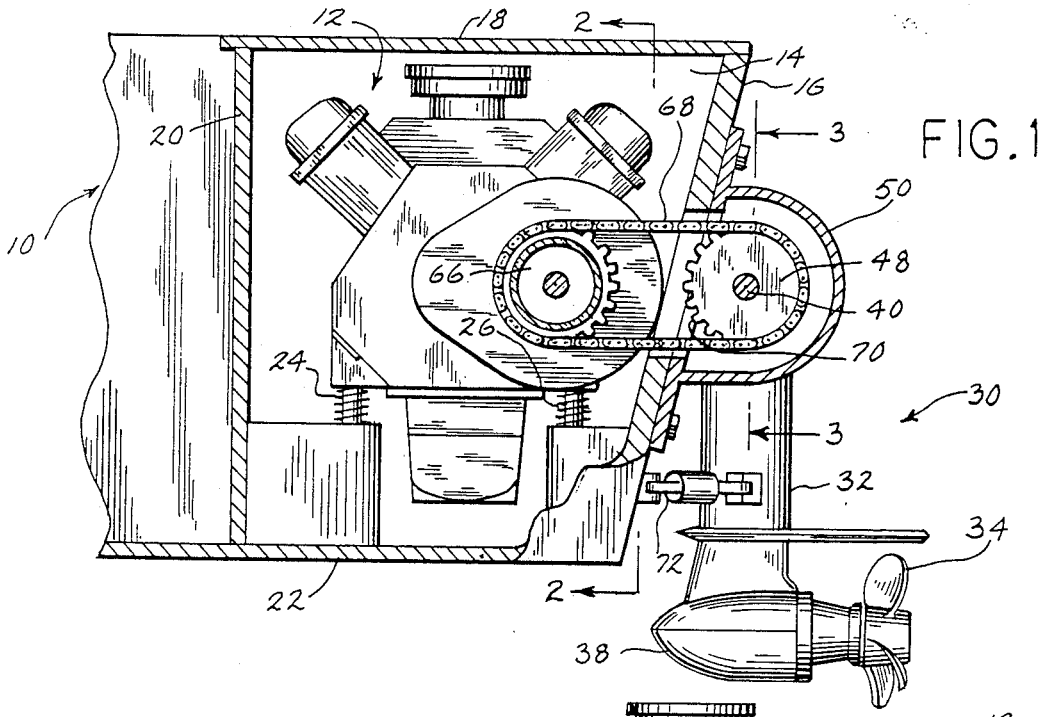
FIG. 1 is a partial side sectional view showing the general arrangement of the engine, lower unit and drive means of the present invention.

With reference to FIG. 1, a marine propulsion system for mounting in the aft portion of a boat 10 includes an internal combustion engine 12. Engine 12 is mounted in a compartment 14 formed in the aft end of the boat. Compartment 14 is defined by the transom 16 of boat 10, an upper wall 18, a front wall 20 and boat hull 22. Compartment 14 is constructed so as to isolate sound from engine 12 from the remainder of the interior of boat 10.

As shown in FIG. 1, engine 12 is mounted in compartment 14 so that its longitudinal axis is substantially perpendicular to the longitudinal axis of boat 10. With this orientation, the engine crankshaft (not shown) extends substantially parallel to boat transom 16.

Figure 2:
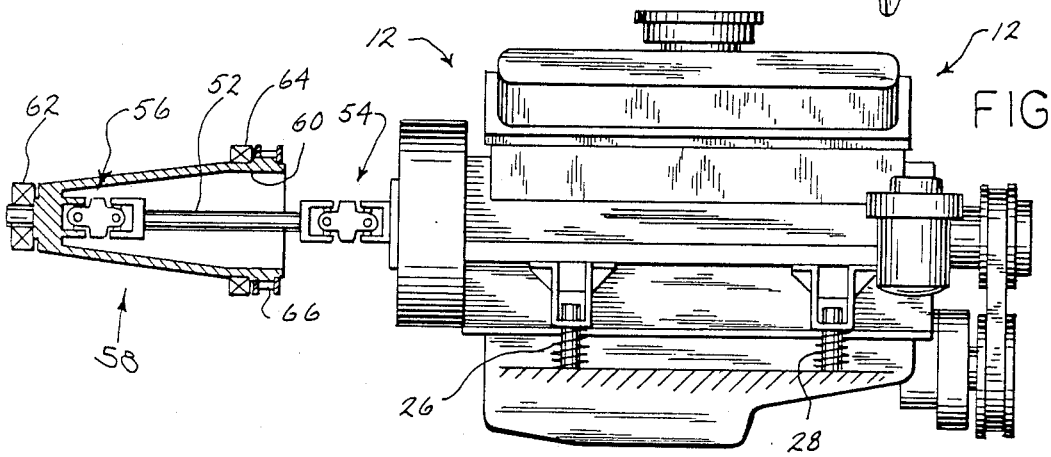
FIG. 2 is a partial sectional view taken generally along lines 2—2 of FIG. 1.

Engine 12 is resiliently mounted in compartment 14 by means of resilient mounts, shown at 24, 26 (FIG. 1) and 28 (FIG. 2). Mounts 24–28 are similar to those used in automotive applications for isolating engine vibrations from the supporting structure. With this construction, vibrations from engine 12 are substantially isolated from boat 10.

A drive unit 30 is rigidly mounted to the exterior of transom 16. Drive unit 30 includes a depending lower unit 32 and a propeller 23. A substantially vertical drive shaft 36 (FIG. 3) extends through lower unit 32, and is interconnected with a substantially horizontal propeller shaft (not shown) to which propeller 34 is connected. As is known, rotary power is transferred from drive shaft 36 and through the propeller shaft to propeller 34. A suitable reversing transmission is typically provided in a torpedo 38 (FIG. 1), within which the propeller shaft is mounted, for providing forward and reverse rotation of propeller 34.

Drive unit 30 is rigidly fixed to the exterior of transom 16 by a mounting bracket or other suitable mechanism (not shown).

Figure 3:
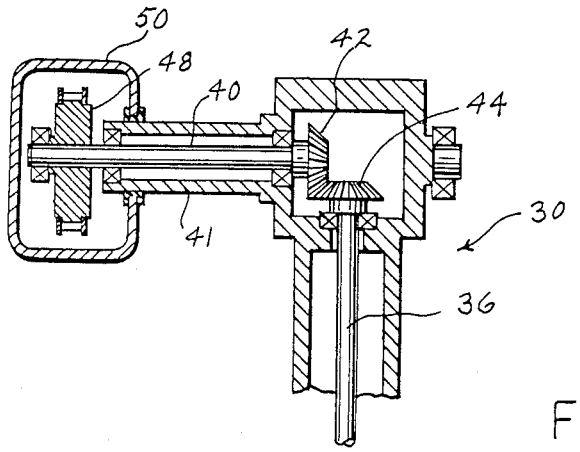
FIG. 3 is a partial sectional view taken generally along line 3—3 of FIG. 1.

An upper jack shaft 40 is provided at the upper end of drive unit 30. Jack shaft 40 is substantially horizontal, and extends parallel to transom 16. As shown in FIG. 3, jack shaft 40 extends within a housing 41, and is provided at its rightward end with a bevel gear 42. Jack shaft bevel gear 42 is engageable with a drive shaft bevel gear 44 connected to the upper end of vertical drive shaft 36. Jack shaft 40 is provided at its leftward end with an input, or driven, sprocket 48, contained within a sprocket housing 50 mounted to the exterior of boat transom 16.

With drive unit 30 and sprocket 48 rigidly fixed to the exterior of boat transom 16, and engine 12 mounted within compartment 14 so as to isolate boat 10 from engine vibrations, a means must be provided for accommodating movements of the engine crankshaft resulting from engine vibration so as to isolate sprocket 48 and drive unit 30 from the effects of such vibration. To this end, a drive shaft 52 (FIG. 2) is connected at its rightward end through a flexible universal joint 54 to the engine crankshaft (not shown). Drive shaft 52 extends substantially parallel to jack shaft 40, and is connected at its leftward end to a second flexible universal joint 56, which is mounted to the interior of a drive, or output, sprocket assembly 58. Output sprocket assembly 58 comprises a hollow substantially frusto-conical member having an inner passage 60 extending axially throughout its length. As shown, the rightward end of output sprocket assembly 58, located closest to engine 12, has a diameter greater than the leftward end of sprocket assembly 58. Drive shaft 52 extends through passage 60 substantially coaxially with output sprocket assembly 58. Universal joint 56 is connected at the inner leftward end of output sprocket assembly 58, which is mounted through a bearing assembly 62 against lateral movement. A second bearing assembly 64 is provided at the rightward end of sprocket assembly 58 to brace sprocket assembly 58 against lateral movement. A series of teeth 66 are provided about the outer periphery of output sprocket assembly 58 at its rightward end. A chain 68 is provided about teeth 66 of output sprocket assembly 58, and engages a series of teeth 70 provided about the periphery of input sprocket 48. As an alternative means for transferring power from output sprocket assembly 58 to input sprocket 48, chain 68 may be replaced by a belt.

As is known, a tilt cylinder 72 is provided for effecting tilting movement of drive unit 30 about a tilt axis defined by upper jack shaft 40. A satisfactory steering mechanism is provided for effecting steering movement of lower unit 30 about a steering axis defined by vertical drive shaft 36.

With the described construction, vibrations of engine 12 are substantially isolated from the drive system. Universal joints 54 and 56 accommodate movements of the engine crankshaft resulting from such vibrations, thereby isolating sprocket assembly 58 from the effects of such movement. In this manner, movements resulting from engine vibration have little or no effect on the operation of the drive system.

Various alternatives and modifications are contemplated as being within the scope of the following claims particularly pointing out and distinctly claiming the invention.

I claim:

1. A marine propulsion system for use in a boat, comprising:

an engine adapted for mounting in the aft portion of the boat adjacent to transom, said engine being mounted within said boat by resilient mounting means for isolating said boat from engine vibrations, said engine including a rotatable crankshaft;

a drive unit adapted for mounting to the transom of the boat, said drive unit including a propeller interconnected with power transfer means;

drive means for drivingly interconnecting said engine crankshaft with said power transfer means, said drive means comprising a first rotatable member interconnected with said engine crankshaft and rotatable in response to rotation thereof, and a second rotatable member interconnected with said drive unit for inputting rotary power thereto, said first and second rotatable members being substantially fixed in position relative to each other and engageable with each other for transferring rotary power from said first rotatable member to said second rotatable member;

means associated with said drive means for accommodating movement of said engine crankshaft resulting from engine vibrations for isolating said drive unit from the effect of engine vibrations, said movement accommodating means comprising a drive shaft interconnected with said engine crankshaft through a first flexible joint, said drive shaft being interconnected with said first rotatable member through a second flexible joint, said first and second flexible joints acting to isolate said first rotatable member from movement of said engine crankshaft resulting from engine vibration;

wherein said drive unit is rigidly mounted to the exterior of the transom of the boat, and wherein said means for accommodating movement of said engine crankshaft is associated with said drive means; and wherein said power transfer means includes a rotatable shaft disposed in the upper end of said drive unit defining a pivot axis about which said drive unit is pivotable, said drive unit rotatable shaft being interconnected with said second rotatable member for inputting rotary power to said drive unit.

2. The marine propulsion system of claim 1, wherein said engine is mounted in a chamber at the aft end of the boat for isolating the engine from the interior of the boat, with one wall of said chamber defined by the transom of the boat.

3. The marine propulsion system of claim 2, wherein said engine is mounted so that its longitudinal axis extends substantially perpendicular to the longitudinal axis of said boat, so that said engine crankshaft extends substantially parallel to the transom of said boat.

4. The marine propulsion system of claim 1, wherein said first rotatable member comprises a drive sprocket and said second rotatable member comprises a driven sprocket, said drive and driven sprockets being engageable with each other by means of a chain.

5. The marine propulsion system of claim 1, wherein said first and second flexible joints comprise first and second universal joints.

6. The marine propulsion system of claim 1, wherein said first rotatable member includes an axially extending inner passage, and wherein said first rotatable member is connected to said second flexible joint at an end of said inner passage, said drive shaft extending substantially coaxially through said inner passage.

7. The marine propulsion system of claim 6, wherein said first rotatable member includes tooth means for engaging said first rotatable member with said second rotatable member, and wherein said tooth means is provided about the periphery of said first rotatable member adjacent an end of said first rototable member spaced from the end of said first rotatable member to which said second flexible joint is connected.

8. The marine propulsion system of claim 7, wherein said first rotatable member comprises a hollow substantially frusto-conical member having an end of greater diameter and an end of lesser diameter, and wherein said tooth means is provided about the outer periphery of said frusto-conical member adjacent said end of greater diameter, and wherein said second universal joint is connected to said frusto-conical member in the interior thereof adjacent said end of lesser diameter.

* * * * *

UNITED STATES PATENT AND TRADEMARK OFFICE

CERTIFICATE OF CORRECTION

PATENT NO. : 4,925,414

DATED : May 15, 1990

INVENTOR(S) : Neil A. Newman

It is certified that error appears in the above-identified patent and that said Letters Patent is hereby corrected as shown below:

Claim 7, Col. 4, Line 56, Delete "rototable" and substitute therefor --- rotatable ---.

Signed and Sealed this

Sixth Day of August, 1991

*Attest:*

HARRY F. MANBECK, JR.

*Attesting Officer*

*Commissioner of Patents and Trademarks*